US008540539B2

(12) United States Patent
Derin-Holzapfel

(10) Patent No.: US 8,540,539 B2
(45) Date of Patent: Sep. 24, 2013

(54) BUOYANCY AID WITH RESIDUAL BUOYANCY

(75) Inventor: Désirée Derin-Holzapfel, Volkerode (DE)

(73) Assignee: Derin Holzapfel & Co. Grundbesitz Und Beteilgungs KG, Meinhard-Frieda (DE)

( * ) Notice: Subject to any disclaimer, the term of this patent is extended or adjusted under 35 U.S.C. 154(b) by 1234 days.

(21) Appl. No.: 11/252,520

(22) Filed: Oct. 18, 2005

(65) Prior Publication Data

US 2007/0021017 A1 Jan. 25, 2007

(30) Foreign Application Priority Data

Jul. 19, 2005 (EP) ..... 05015621

(51) Int. Cl.
*B63C 9/08* (2006.01)

(52) U.S. Cl.
USPC ..... 441/122

(58) Field of Classification Search
USPC ..... 441/113, 122, 125; 114/345
See application file for complete search history.

(56) References Cited

U.S. PATENT DOCUMENTS

| | | | | |
|---|---|---|---|---|
| 3,727,252 | A * | 4/1973 | Bauermeister | 441/122 |
| 4,626,221 | A * | 12/1986 | Rocco | 441/108 |
| 5,304,082 | A | 4/1994 | Wolfe | |
| 5,382,184 | A | 1/1995 | DiForte, Jr. | |
| 6,342,031 | B1 | 1/2002 | Vaughan | |
| 2003/0068939 | A1 | 4/2003 | Ishihara | |
| 2004/0011801 | A1* | 1/2004 | Rodriguez | 220/737 |
| 2004/0069203 | A1* | 4/2004 | Fleming | 114/345 |

FOREIGN PATENT DOCUMENTS

| | | |
|---|---|---|
| EP | 0 055 791 A2 | 7/1982 |
| GB | 1 344 284 | 1/1974 |
| GB | 2 090 792 A | 7/1982 |

* cited by examiner

*Primary Examiner* — Stephen Avila
(74) *Attorney, Agent, or Firm* — RatnerPrestia

(57) ABSTRACT

A buoyancy aid for assisting in swimming lessons and for placing onto an arm, comprising:

a) an element which is ring-shaped or which can be connected into a ring, and which can be arranged on an arm;

b) an inflatable chamber which is attached to the ring-shaped element; wherein c) the chamber and/or the element which is ring-shaped or which can be connected into a ring comprise(s) a material having a density lower than the density of water.

27 Claims, 2 Drawing Sheets

(A - A)

BUOYANCY AID WITH RESIDUAL BUOYANCY

BACKGROUND OF THE INVENTION

1. Technical Field of the Invention

The invention relates to a buoyancy aid for assisting in swimming lessons and for placing onto an arm, in particular the upper arm, the floatability of which is independent of an extent to which an inflatable chamber is inflated, such that a residual buoyancy or reserve buoyancy is provided. The invention further relates to a method for producing such a buoyancy aid.

2. Description of the Prior Art

Buoyancy aids, in particular water wings for placing onto an upper arm, are known from the prior art, consisting in most cases of two inflatable floating chambers which are connected together and surround the point at which the buoyancy aid is to be arranged. When inflated, the buoyancy aid is attached to the upper arm.

An inflatable floating arm ring is known from European patent application No. 0 055 791, comprising a plurality of parallel, inflatable floating chambers and a connecting member which connects the ends of the floating chambers together and, in its normal position for use, is designed to be placed on the inner side of the user's upper arm, such that when one or more of the floating chambers are inflated, the arm strip is held, without support, on the user's upper arm. Known buoyancy aids consist of a soft plastic film such as for example polyvinylchloride, from which the buoyancy aid and/or the floating chambers are formed.

If the inflated floating chambers are deflated, then these buoyancy aids sink in water and can moreover detach from the user's arm.

SUMMARY OF THE INVENTION

It is an object of the invention to provide a buoyancy aid having a residual buoyancy or reserve buoyancy, which can be simply fixed to a part of the body, and the buoyancy of which can be varied without loosening the fixing. It is another object of the invention to provide a method for producing such a buoyancy aid.

A buoyancy aid in accordance with the invention for assisting in swimming lessons can be attached to an arm. Attaching the buoyancy aid to an arm is preferably understood to mean a frictional connection which can fix the buoyancy aid sufficiently securely to the arm that it cannot slide off the arm during normal swimming strokes or normal strains, or during swimming strokes or strains which do not go substantially beyond the norm. This can for example be assisted by providing the area of the buoyancy aid placed on the arm with a slide-resistant surface. It is also possible to configure the surface placed on the arm such that it allows the skin to breathe and/or is gentle on the skin. For attaching the buoyancy aid to the arm, the buoyancy aid comprises an element, in particular a fastenable element, which is ring-shaped or which can be connected into a ring, and which can be arranged around the arm. The element which is ring-shaped or which can be connected into a ring can be elastic or can comprise at least one elastic section. Preferably, the ring-shaped element is a circumferential strip. The element which is ring-shaped or connected into a ring can for example, when not placed on the arm, exhibit a smaller circumferential length than the arm exhibits at the point at which the buoyancy aid is to be placed. In other words, the element which is ring-shaped or which can be connected into a ring is stretched when placed on the arm, such that the circumferential length of the ring is increased and the element is placed securely on the arm. The ring-shaped element can in particular not be detached.

Alternatively, the element which is ring-shaped or which can be connected into a ring can exhibit a larger circumference than the point on the arm onto which the buoyancy aid is to be placed. To this end, it is preferable for an inflatable chamber of the buoyancy aid to be sufficiently inflated that the ring-shaped element is placed securely on the arm. The ring can be designed to be elastic or non-elastic or can comprise an elastic section. It is also preferable for the ring to be provided with a fastening. The fastening can comprise at least two overlapping sections which can be connected together by means of a Velcro fastening, buttons, a zip, a plug connection, a catch connection or a clamp connection. The overlapping sections can consist of strips which are laid on top of one another. In the case of a zip, the teeth overlap and thus form the overlapping sections. The overlapping sections, which preferably consist of a strip, can in particular be connected such that the short end of a section is fed around for example a clasp of the other section and back towards a long end of the section forming the short end. The long end is connected at one end to the short end and is connected at the other end to the ring-shaped element. The short end is connected at one end to the long end and is free at the other end. In order to prevent the fastening from being undesirably opened, it is preferable for the short end to be located between the arm and the long end when the fastening is closed. In particular, in the embodiment in which the buoyancy aid is attached to the arm by inflating a chamber, it is advantageous if the circumferential length of the ring can be adjusted or opened and fastened, in order to be able to securely place the buoyancy aid on the arm.

The buoyancy aid comprises at least one inflatable chamber which is attached to the element which is ring-shaped or which can be connected into a ring. "Attached" can in particular be understood to mean that the at least one chamber is connected to the element which is ring-shaped or which can be connected into a ring. This also includes the case in which the at least one chamber is at least partially surrounded or enveloped by an element and this element is connected to the element which is ring-shaped or which can be connected into a ring. The fixing of the buoyancy aid to the arm can for example be dependent on the level of inflation of the at least one chamber or the extent to which the at least one chamber is inflated. Preferably, however, the fixing of the buoyancy aid to the arm is independent of the at least one inflatable chamber.

The at least one chamber can for example be an auxiliary chamber or a fixing chamber. At least one fixing chamber and one auxiliary chamber can for example be arranged on the element which is ring-shaped or which can be connected into a ring. An auxiliary chamber can preferably be inflated or deflated without this having a substantial influence on the fixing of the buoyancy aid to the arm. A fixing chamber can preferably only be inflated or deflated with an influence on the fixing to the arm.

The buoyancy aid in accordance with the invention is characterized in that it comprises a for example flexible material, the density of which is lower than that of water. The chamber and/or the element which is ring-shaped or which can be connected into a ring can comprise at least one layer made of a material having a density which is lower than the density of water. The density of water includes the density of both freshwater and saltwater. Water has a density of approximately 1 $kg/dm^3$. The density of the material can for example be in a range between 0.9 kg/dm$^3$ and 0.02 kg/dm$^3$. Where nothing else is mentioned here, a material of a lower density refers to a material exhibiting a lower density than water. The material can be a natural substance such as for example a substance including natural rubber or a plastic. The lower density of the material can be achieved on the one hand by the substance exhibiting a lower density, or on the other hand by a gas having been added to the substance, said gas reducing the density of the substance/gas mixture, i.e. of the material. Foams may be cited as an example of this. The material having a lower density than the density of water can in particular exhibit a porosity, in particular an open and/or preferably a closed porosity. In the case of an open porosity, water can for example enter the porous material. In the case of a closed porosity, gas bubbles are for example trapped securely in the material, such that substantially no water can enter the material and displace the gas, whereby the material substantially cannot be saturated with water even when surrounded by water. A mixture of open and closed porosity is also possible, wherein the proportion of closed porosity preferably outweighs the proportion of open porosity. Materials made of foamed synthetic rubber based on Chloroprene or Neoprene are for example particularly suitable. Foamed, in particular elastic plastics are also preferable. Foams made of polyurethane or polystyrene, foamed rubber, rubber derivates or foamed elastomers can also for example be the material having the density lower than water. In particular, a density below 0.5 kg/dm$^3$ can also be advantageous for the material of lower density.

The material of lower density can in particular be strip-shaped or layered, preferably strip-shaped and layered. In water, the whole material exhibiting the lower density and applied to the buoyancy aid preferably generates half the buoyancy which is sufficient to keep at least the nose, preferably also the mouth of the buoyancy aid user, above the surface of the water. This assumes that the user is not carrying out any swimming strokes. Since the user wears a buoyancy aid on each arm, it is again sufficient if one buoyancy aid generates at least half of this buoyancy.

The layer thickness of the material of lower density is in particular decisive in generating the buoyancy of a strip-shaped material which is designed in layers. The layer thickness of the buoyancy aid can for example be adapted to the body size of the user and/or an associated age of the user. The buoyancy aid can for example be adapted to the average body size of a baby, a small child, a pre-school child, a school child, a youth or an adult. In particular, the material having a lower density can exhibit a layer thickness of 0.1 mm to 10 or 20 mm, preferably 2 mm to 5 mm. For the material of lower density, a layer thickness of 2 mm can for example result in a volume of 180 to 400 cm$^3$, or a layer thickness of 3 mm can result in a volume of 270 to 600 cm$^3$. Proceeding from the volumes given, the volume of the material of lower density can in particular vary in proportion to the layer thickness.

When approximately fully inflated, two or a pair of buoyancy aids can preferably generate a buoyancy of at least 20 to 30 N per pair, in particular 25 N per pair, if they are fully submerged. It is generally preferable for the buoyancy aid to be constructed such that, when approximately fully inflated, it can generate a buoyancy of 30 to 70 N per pair, e.g. 45 to 55 N per pair. When not inflated, in particular when the at least one chamber has been approximately fully deflated, a buoyancy of 5 to 15 N per pair can for example be provided. A buoyancy aid in accordance with the invention can particularly preferably exhibit a buoyancy ratio, from being inflated to being non-inflated, of 14:1 to 2:1.

The plastics of this invention can furthermore contain common supplements and additives, in particular plasticizers, processing stabilizers and weathering stabilizers.

Plasticizers are generally supplements which influence the rigidity of the material. Typical plasticizers are esters of multi-basic acids comprising univalent alcohols. The esters of phthalic acid, such as for example dioctylphthalate, are in particular suitable here. However, polyesters of glycols with dibasic acids, such as for example sebacic acid, can also be used.

Processing stabilizers are generally supplements which prevent decomposition reactions during processing. A typical example is diphenylthiourea.

Weathering stabilizers are generally supplements which protect the material from weathering influences and light. Typical examples are common commercial barium, cadmium, zinc or tin compounds, for example in combination with UV absorbers such as benzophenone derivates, soot or titanium dioxide.

Other suitable additives are ageing protecting agents, antioxidants and antiozonants, fillers and odor enhancers, inhibitors, oxygen removers, passivation agents and flame retardants.

The at least one chamber can preferably be surrounded by a layer made of a material which is impermeable to gas. The layer can include the material exhibiting the density lower than water. The layer can also be a film which is impermeable to gas and fluid. The layer surrounding the chamber can for example be connected in a material lock, in particular film-clad, on the layer made of the material having the density lower than water. The two layers can, however, also be separate from one another. The plastics of this invention can furthermore contain the commonly used supplements and/or additives, such as for example plasticizers, processing stabilizers, weathering stabilizers.

Particularly preferably, the layer made of a material having a density lower than the density of water is covered, stuck together or film-clad, on at least one side, to the layer made of the material which is impermeable to gas. It is also preferable for the layer made of the material having the density lower than the density of water to be covered, stuck together or film-clad, on at least one side, to a layer made of a sealing, abrasion-proof, color-tagged and/or textile material.

A fastening can be provided for the ring-shaped element, such that the ring-shaped element can be opened or can be fastened or connected into a ring. In particular, the fastening can set the length of the ring-shaped element, with which the element surrounds the point at which the buoyancy aid can be attached. The ring-shaped element can for example be drawn closed or extended until it is securely placed on the arm, similar for example to a cuff, but does not squeeze the arm unpleasantly. The ring-shaped element can in particular be elastic or can comprise an elastic section, such that when the ring-shaped element is drawn closed, an unpleasant pressure on the tissue onto which the ring-shaped element is placed is prevented. The ring-shaped element for placing onto an arm can for example be a strip which does not necessarily have to, but can, comprise a chamber. Particularly preferably, the strip includes a layer made of the material, the density of which is lower than that of water.

In a particularly preferable embodiment, the ring-shaped element—in particular the cuff—for attaching to an arm is surrounded at least partially by another ring-shaped element. The ring-shaped element for attaching to the arm can be attached to the other ring-shaped element, as is also preferable. Particularly preferably, the at least one inflatable chamber is formed on the other ring-shaped element, i.e. the element which surrounds the ring-shaped element for attaching to an arm. The ring-shaped element for attaching to an arm can be located between the other ring-shaped element and the arm. The one ring-shaped element and the other ring-shaped element can in particular comprise a common ring section which in particular connects the one ring-shaped element and the other ring-shaped element together.

The ring-shaped element for attaching to an arm can in particular be at least partially surrounded by and connected to at least two additional elements which substantially form a ring or can be connected into a ring. The at least one chamber can be formed between the at least two additional elements. There can then be at least three ring-shaped elements in total, wherein one, i.e. for example the one surrounded by the at least two other ring-shaped elements, can be provided only for fixing to the arm. Preferably, there can be a gap between the ring-shaped element placed on the arm and the ring-shaped element spaced nearest to it, such that the two ring-shaped elements are disassociated from one another with regard to the attachment to the arm. The ring-shaped element placed on the arm can in particular not comprise a chamber and can serve only to attach to the arm. The at least one chamber is preferably enveloped or substantially completely surrounded by at least two elements, preferably the additional elements.

It can generally be preferable for two or more ring-shaped elements to be connected together, using a suitable connecting element, at substantially one point on their circumferences. This can for example be a seam, along which the ring-shaped elements are sewn or fused. The ring-shaped element for attaching to an arm can for example be connected to the at least one or the at least two additional ring-shaped elements. The at least one seam can run in the circumferential direction of the ring-shaped element or elements or/and in the longitudinal direction of the arm.

In a particularly preferable embodiment, the ring-shaped element surrounding the ring-shaped element serving to attach to the arm can comprise at least one chamber, such as for example a fixing or/and an auxiliary chamber. The chamber can for example be formed in or inserted in the other ring-shaped element. The ring-shaped element can for example comprise a pocket which can be opened, into which at least one chamber can be inserted as a separate part, or can comprise several pockets which can be opened, into each of which at least one chamber can be inserted as a separate part. A pocket can be fastened, for example using a suitable fastening element such as for example a zip, buttons, a Velcro fastening or by sewing, in order to prevent a separate chamber from slipping out of a pocket formed by the outer ring-shaped element. In particular, several chambers can be provided in one pocket, or several pockets can be provided for several chambers or for one chamber each. The outer ring-shaped element can comprise a hose section, wherein the lumen formed by the hose forms at least one pocket. The hose can also be sub-divided into several separate pockets, as can for example be achieved by stitching with seams or by sticking it together. Several chambers can for example be arranged in the outer ring, in rows in the longitudinal direction of the arm or in the radial direction of the arm. Flanks can for example also be formed by the ring-shaped element and can surround the attachment section of the arm. At least one chamber can be arranged in each flank. Several chambers can for example also be fluidly connected together, such that gas can be exchanged between them. Chambers within a flank or chambers from different flanks can be connected. Chambers are preferably connected in pairs.

The at least one inflatable fixing chamber can be formed by chambers which are arranged on or in the ring-shaped element. This also includes the fixing chamber being formed by the ring-shaped element, by providing a multi-layered material for the ring-shaped element. At least one inflatable auxiliary chamber is located on the ring-shaped element, wherein the auxiliary chamber can also be arranged on the fixing chamber. The fixing chamber can equally be arranged on the auxiliary chamber.

Advantageously, a fixing chamber can be connected to at least one other fixing chamber via an overflow element, such that gas can be exchanged between the fixing chambers connected in this way. In one embodiment, one chamber is connected to another chamber via an overflow element. This other chamber is in turn connected, via an overflow element, to a subsequent new chamber, etc. In another embodiment, a chamber is connected to other fixing chambers via several overflow elements.

In the case of several fixing chambers, all the fixing chambers can preferably be connected together by at least one overflow element, such that gas can be exchanged between the fixing chambers connected in this way. At least one overflow element can be provided in the connection from one fixing chamber to another, which produces the exchange of gas, such that two chambers can for example be connected to several overflow elements.

Several fixing chambers can form a fixing chamber system, wherein for each fixing chamber system, at least one valve is provided for inflating the fixing chamber system. In order to also be able to inflate fixing chambers which are not connected to the fixing chamber system, a valve for inflating can be provided for each fixing chamber connected in such a way that gas cannot be exchanged. A valve, in particular a safety valve for inflating, can for example be provided by a stopper valve comprising a reflux device. After inflating, the valve is preferably pushed into the air cavity, such that the danger of scratching or injury which would result from a valve sticking out is minimized. Instead of a stopper valve comprising a reflux device, any valve is in principle suitable which allows gas to be supplied and intentionally released into and/or out of the chamber, but prevents gas from being unintentionally released from the chamber.

The above embodiments with respect to one or more fixing chambers apply equally to arranging and connecting one or more auxiliary chambers.

Preferably, the level of inflation of the auxiliary chamber(s) does not influence the level of inflation of the at least one fixing chamber, such that the fixing of the buoyancy aid to the arm is substantially independent of the extent to which the auxiliary chamber(s) is/are inflated. In this case, the auxiliary chamber and fixing chamber, and the auxiliary chamber system and fixing chamber system, do not comprise any connections to one another, such that the chamber systems are separated respectively from one another. In this embodiment, the fixing chambers which are at least partially inflated ensure the secure fitting on the arm, independent of whether the auxiliary chambers are inflated with gas or not, since the level of inflation of the auxiliary chambers does not influence the fixing chamber or the fixing chamber system. The auxiliary chambers are preferably arranged on the buoyancy aid or swimming aid in such a way that the inner space of the buoyancy aid, provided for inserting an arm, is not or is only insubstantially influenced by the level of inflation of the auxiliary chambers, and preferably only influenced by the level of inflation of the fixing chamber(s). The auxiliary chambers can be arranged on an outer side of the buoyancy aid, such that the fixing chamber is for example located between the arm and the auxiliary chamber. Preferably, the auxiliary chamber cannot or can only insubstantially be placed on the arm, independent of the level of inflation of the fixing chamber, such that the fixing and/or the strength of the frictional lock which is formed between the buoyancy aid and the arm is substantially independent of the level of inflation of the auxiliary chamber.

The buoyancy aid for assisting in swimming lessons can for example be slid over the arm in a liquid, when only partially inflated or non-inflated, and fixed on the arm when inflated. In particular, the buoyancy aid can include: two flank elements which are connected together in such a way that a closed ring is formed, through which the arm can be inserted; the at least one inflatable fixing chamber which is formed by at least one flank element of the two flank elements, wherein the at least one fixing chamber can fix the buoyancy aid, when inflated, on the arm; and the at least one inflatable auxiliary chamber formed by at least one flank element, wherein the buoyancy of the buoyancy aid in the liquid can be set by the extent to which the at least one auxiliary chamber is inflated.

A fixing chamber can also generally be used as an auxiliary chamber and vice versa, for example in the case of a symmetrical arrangement of the chambers.

A valve, preferably a safety valve, can in particular be provided for each chamber or for one of the connected chambers, using which the chamber or chambers can be inflated or deflated, in particular with gas such as for example air. In particular in the case of chambers which can be inserted into the ring-shaped element, an opening for the passage of the safety valve(s) can be provided in the ring-shaped element.

The ring-shaped element can for example comprise two strip sections which are placed on top of one another and are fused, stuck together, sewn or joined together using another joining means known from the prior art, at least on a longitudinal edge, in order for example to form a hose. The hose can for example be formed from a strip, one longitudinal edge of which is placed on the other longitudinal edge, approximately along its longitudinal central axis, and the longitudinal edges placed on top of one another can be sewn together. Alternatively, two strips can be placed on top of one another and the two pairs of longitudinal edges placed on top of one another can be joined together. In particular, a seam protection can be provided for the longitudinal edges joined together, which can shield the joined edges from external influences, such that damage to the joined edges can be prevented. The seam protection can be a strip overlapping the seam, in particular a fabric strip.

In particular where two flank elements meet, and/or on the ligament element, the buoyancy aid can exhibit a smaller width, measured in the longitudinal direction of the arm, than the flank(s) containing the chamber(s). The width of the ligament element can for example be smaller than the width where the flank elements meet, or vice versa.

BRIEF DESCRIPTION OF THE DRAWINGS

In the following, the invention is described on the basis of several example embodiments which can also be logically combined to develop the subject matter of the invention. There is shown.

DETAILED DESCRIPTION OF THE DRAWINGS

Figure 1:
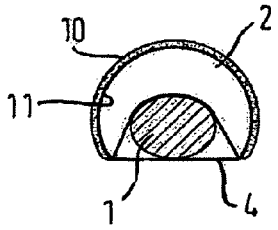
FIG. 1 a cross-sectional view of a buoyancy aid comprising one chamber.

FIG. 1 shows a cross-sectioned buoyancy aid which includes a ring-shaped element which comprises a chamber 2 and a ligament element 4. An arm 1 is surrounded between the chamber 2 and the ligament element 4 which fixes the buoyancy aid to the arm 1 using the chamber 2 which is inflated using a gas, in particular air or exhaled air. The chamber 2 is surrounded by a layer 11 made of a material which is impermeable to gas. As shown in this example, a layer 10 made of a material exhibiting a density which is lower than that of water is arranged on the side of the chamber 2 pointing away from the arm 1. The buoyancy aid is thus capable of floating, even when the chamber 2 is deflated. The ligament element 4 can also comprise a layer 10 made of the material of lower density or can consist of the material of lower density, as however not shown in FIG. 1.

Figure 2:
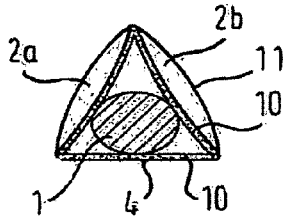
FIG. 2 a cross-sectional view of a buoyancy aid comprising two chambers.

FIG. 2 shows a cross-sectioned buoyancy aid which comprises a ring-shaped element which includes a chamber 2*a*, a chamber 2*b* and a ligament element 4. The arm 1 is surrounded by the chambers 2*a*, 2*b* and the ligament element 4, similar to the sides of a triangle. The buoyancy aid is fixed to the arm 1 by inflating at least one of the chambers 2*a*, 2*b*. The ligament element 4 includes a layer made of a material having a lower density. The sides of the chambers 2*a*, 2*b* pointing towards the arm 1 comprise a layer 10 made of a material of lower density. The chambers 2*a*, 2*b* could nonetheless be coated with the layer 10 on the side of the chambers 2*a*, 2*b* pointing away from the arm 1, or completely coated. In the example shown, the layer 10 is connected securely to a layer 11 forming the chambers 2*a*, 2*b*.

Figure 3:
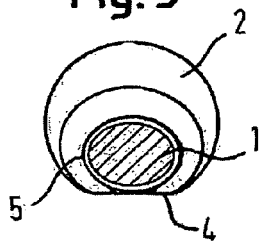
FIG. 3 a cross-sectional view of a buoyancy aid comprising two ring-shaped elements.

FIG. 3 shows a cross-sectioned buoyancy aid including: a ring-shaped element which comprises a ligament element 4 and a chamber 2; and another ring-shaped element 5 in the form of a cuff. The cuff 5 and the ring 2, 4 are connected together. A section of the ligament element 4 forms a common ring section for the two ring-shaped elements. The ring-shaped element 5 for attaching to the arm 1 is surrounded by the other ring-shaped element 2, 4, such that the ring-shaped element 5 is located between the arm 1 and the chamber 2. The cuff 5 is elastic, such that the cuff 5 expands when the buoyancy aid is placed on the arm 1 and, due to its elasticity, fits securely on the arm 1. It is then advantageous for the fitting of the buoyancy aid on the arm 1 to be independent of the level of inflation of the chamber 2. With respect to their walls, the walls of the chamber 2, the ligament element 4 and/or the cuff 5 can comprise a cross-section which corresponds for example to the cross-sections shown in FIGS. 4 and 5.

Figure 4:
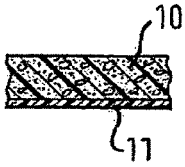
FIG. 4 a cross-sectional view of a wall of the buoyancy aid.

FIG. 4 shows a layer 10 made of a material exhibiting a lower density than that of water, in order to ensure the floatability of the buoyancy aid, even when the chambers are deflated. Such a material can be porous, in particular with an open or closed porosity. The material is preferably a foamed plastic, such as for example Neoprene. Since some of these materials are sometimes not impermeable to gas, a layer 11 made of a material which is impermeable to gas can for example be film-clad or stuck onto the layer 10. By using sandwiching materials, individual properties of the layers 10, 11 can be combined. The layer 11 which is for example impermeable to gas can preferably be arranged on the side of the layer 10 which points towards the chamber 10 which can be inflated with gas. The layer 11 can alternatively or additionally comprise a material which is abrasion-proof or damage-resistant, in order to protect the layer 10 from mechanical or chemical damage. The layer 11 can also protect the layer 10 from photo-chemical damage, such as for example the effect of UV radiation from the sun.

Figure 5:
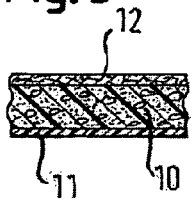
FIG. 5 a cross-sectional view of an alternative wall of the buoyancy aid.

FIG. 5 shows a layer 10 made of a material having a lower density than that of water and comprising a layer 11; 12 on each of its upper and lower side. The layers 11 and/or 12 can for example exhibit the properties of the layer 11 as outlined in connection with FIG. 4. The materials which the layer 10 can consist of can for example be partially susceptible to damage. In order to avoid damage to the layer 10, the layer 10 can be stuck together or film-clad to a layer 12 which exhibits the properties of being abrasion-proof or damage-resistant. Additionally or alternatively, the layer 12 can also exhibit sealing properties or color-tagging properties, such as those of a color code. In particular, the layer 12 can consist of a textile material. The layer 11 is preferably impermeable to gas, in order to prevent the gas contained in a chamber from escaping. It is also possible for the layer 10 to be provided with a layer 11 or a layer 12 on both sides.

Figure 6:
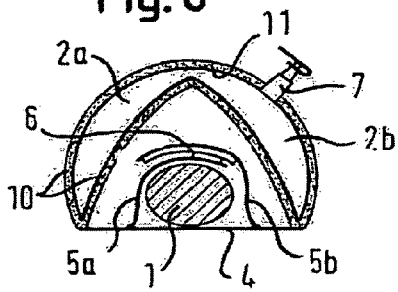
FIG. 6 a cross-sectional view of a buoyancy aid comprising two ring-shaped elements, one of which comprises a fastening.

FIG. 6 shows a cross-sectioned buoyancy aid which comprises a ring-shaped element 5*a*, 5*b*, 4 which can be attached to an arm 1, and a ring-shaped element 10, 4 connected to the ring-shaped element 5*a*, 5*b*, 4 and including the chambers 2*a*, 2*b*. The ring-shaped element 5*a*, 5*b* which can be attached to an arm 1 comprises a fastening 6 with which the ring-shaped element 5*a*, 5*b*, 4 can be individually adapted to the thickness of an arm. To this end, the ring-shaped element 5*a*, 5*b*, 4 can be elastic at least in sections or substantially not elastic. A Velcro fastening, a zip, buttons or another connecting means known from the prior art, such as for example catch, clamp or plug connections, can for example serve to connect the ring section 5*a* to the ring section 5*b*. The wall shown bearing the reference sign 10 serves only as an example and can also be substituted by a wall as shown in FIGS. 4 and 5. Two chambers 2*a*, 2*b* which are fluidly connected together have been inserted in the hollow space formed by the layer 10. They can be inserted for example by a user of the buoyancy aid using an opening in the wall which can be opened and fastened, or can already have been inserted in the production process, wherein when the chambers are inserted during the production process, an opening for subsequently taking out the chambers may not be provided. The walls of the chambers 2*a*, 2*b* preferably include a layer 11. A design according to FIG. 4 or also according to FIG. 5 would for example be possible. Since the chambers 2*a*, 2*b* are fluidly connected, one valve 7 protruding through an opening in the wall 10 is sufficient to inflate and deflate the chambers 2*a* and 2*b*. The buoyancy aid fits securely on the arm 1, independent of the extent to which the chambers 2*a*, 2*b* are inflated, since the ring-shaped element 5*a*, 5*b*, 4 can be adapted to the arm using the fastening 6.

Figure 7:
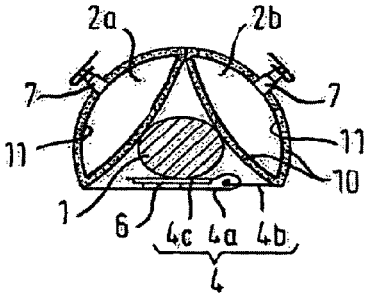
FIG. 7 a cross-sectional view of a buoyancy aid comprising two flanks and a separate chamber on each flank.

FIG. 7 shows a cross-sectioned buoyancy aid with a ring-shaped element 10, 4 which surrounds the arm 1. The buoyancy aid can fit securely on the arm 1, independent of the extent to which the chambers 2*a*, 2*b* are inflated, since the fastening can adapt the circumferential length of the ring-shaped element 10, 4 to the extent to which the chambers 2*a*, 2*b* are inflated. To this end, a short end 4*c* of the ligament element 4 is fed via a clasp element 4*b* and connected to a long end 4*a* of the ligament element, parallel to the long end 4*a*, for example by a Velcro fastening. Since, when closed, the short end 4*c* is located inside the ring-shaped element 10, 4, the short end 4*c* cannot be detached from the long end 4*a* through the arm 1 which is also accommodated in it. This excludes the possibility of unintentionally detaching the buoyancy aid from the arm 1.

In the example shown in FIG. 7, the chambers 2*a*, 2*b* are fluidly separate from one another. Each of the chambers therefore comprises a valve 7 of its own. The pockets for the chambers 2*a* and 2*b*, formed by the wall 10, each comprise an opening for the valve 7. The two pockets are connected together at the point at which they meet. The pockets can for example be formed from a hose section 14 (FIGS. 10 and 11) which is stitched or stuck together at the point at which the pockets for the chambers 2*a*, 2*b* meet, in order to form two separate chambers.

Figure 8:
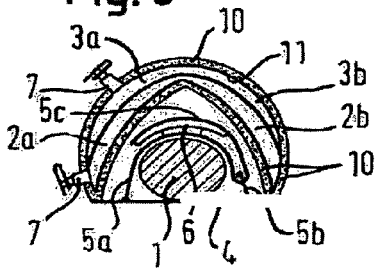
FIG. 8 a cross-sectional view of a buoyancy aid comprising two flanks and pairs of chambers connected via the flanks.

The buoyancy aid from FIG. 8 is attached to the arm 1 using a ring-shaped element 5*a*, 5*b*, 4. The fastening 6 functions in a similar way to the fastening 6 shown in FIG. 7. The short end 5*c* is fed around the clasp element 5*b* and placed on the long end 5*a* and attached by means of a connecting element 6.

Chambers 2*a*, 2*b*, 3*a*, 3*b* are arranged inside the wall 10, wherein the chamber 2*a* is fluidly connected to the chamber 2*b* and the chamber 3*a* is fluidly connected to the chamber 3*b*. A valve 7 is provided for the chambers 2*a* and 2*b* and another valve 7 is provided for the chambers 3*a*, 3*b*. When inflated, the chambers 2*a*, 2*b* can attach the buoyancy aid to the arm 1. The methods from FIGS. 6 and 7 for attaching the buoyancy aid to the arm 1 would therefore also be possible in principle. Since the chambers 2*a*, 2*b* shown in FIG. 8 preferably serve to attach, they are referred to as fixing chambers in connection with this figure. Floating or auxiliary chambers 3*a*, 3*b* pointing radially away from the arm are arranged adjacent to the fixing chambers 2*a*, 2*b*. The fixing chambers 2*a*, 2*b* are therefore located between the arm 1 and the auxiliary chambers 3*a*, 3*b*. The buoyancy of the buoyancy aid can be reduced using the extent to which the chambers 3*a*, 3*b* are inflated. The buoyancy aid nonetheless fits securely on the arm 1, since the fixing chambers 2*a*, 2*b* are placed onto the arm. If, when the user has made moderate progress in learning to swim, such as for example when the floating chambers 3*a*, 3*b* are deflated, the fixing chambers 2*a*, 2*b* unexpectedly lose air, then a residual buoyancy of the buoyancy aid is generated by the layer 10 of the wall, wherein the residual buoyancy at least partially assists the swimmer in swimming. Releasing air from the fixing chambers can even be desired, i.e. for example when the swimmer has made such progress in learning to swim that the buoyancy which the layer 10 generates is sufficient for swimming. The device cannot slide off the arm, even when the fixing chambers are deflated, since it is attached securely to the arm by the ring-shaped element 4, 5*a*, 5*b*.

Figure 9:
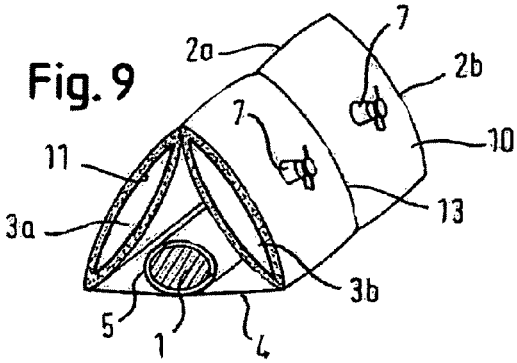
FIG. 9 a perspective view of a buoyancy aid comprising chambers arranged in the longitudinal direction of the arm.

FIG. 9 shows a buoyancy aid in a cut-away perspective. The buoyancy aid is attached to the arm 1 by means of the ring-shaped element 5. The chambers 2*a*, 2*b*, 3*a*, 3*b* are arranged in rows in the longitudinal direction of the arm 1.

Additionally, the pockets for the chambers or the chambers can for example be separated along the line 13, such as for example by stitching, sticking, sewing or the like.

Figure 10:
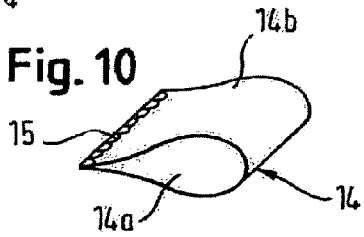
FIG. 10 a perspective view of a hose section.
Figure 11:
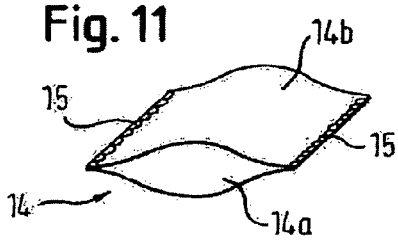
FIG. 11 a perspective view of another hose section.

FIGS. 10 and 11 show ways of producing a hose section 14. The hose section 14 from FIG. 10 consists of a strip-shaped material which is turned over along its longitudinal axis, such that the longitudinal edges placed onto one another form a pair of longitudinal edges and can be connected using a connection 15, such as for example by sewing, sticking or fusing. Chambers can be formed or inserted between the lower hose element 14*a* and the upper hose element 14*b*. The same also applies to the hose section shown in FIG. 11. The hose section from FIG. 11 is formed from a lower strip-shaped hose section 14*a* and an upper strip-shaped hose section 14*b*, wherein the hose sections 14*a*, 14*b* are placed on top of one another and connected along their pairs of longitudinal edges using connections 15.

Figure 12:
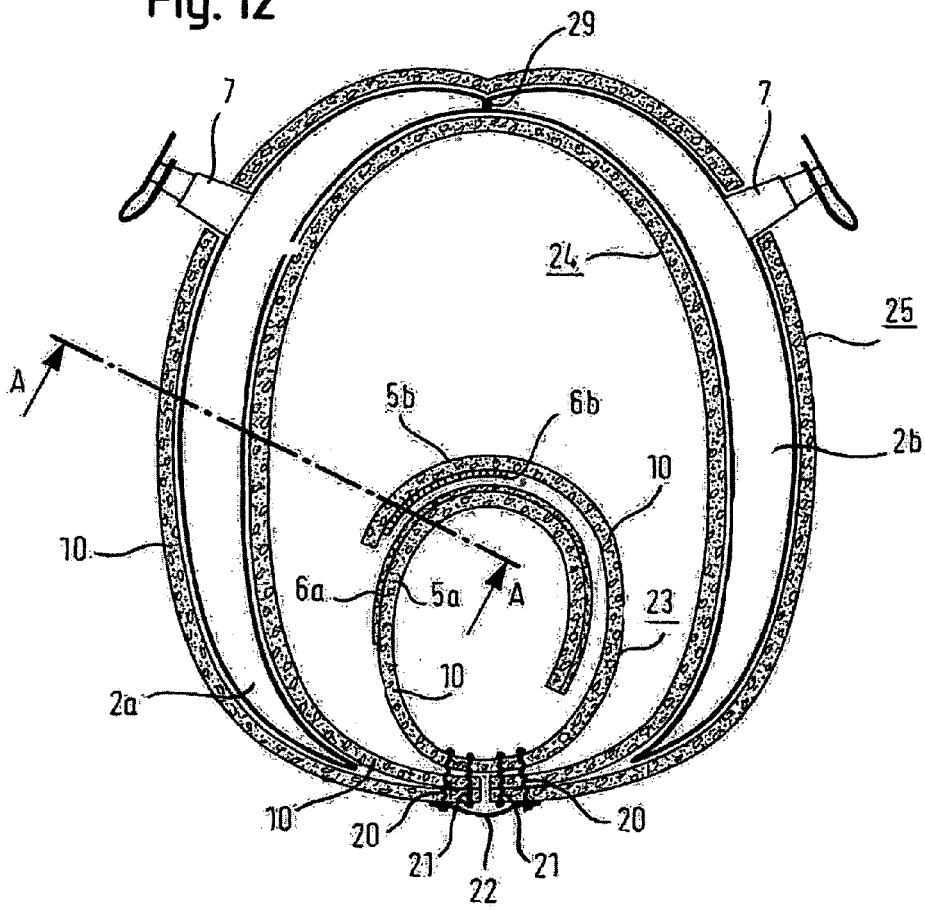
FIG. 12 a cross-sectional view of a particularly preferable embodiment of a buoyancy aid.

FIG. 12 shows a cross-sectional view of a particularly preferable embodiment of a buoyancy aid. The buoyancy aid includes three ring-shaped elements, namely: an inner ring-shaped element 23; a middle ring-shaped element 24; and an outer ring-shaped element 25. Even though the ring-shaped elements 23, 24, 25 are also disconnected, a ring-shaped element is nonetheless understood by them, since the ring-shaped elements 23, 24, 25 are or can be joined together such that they each form a ring. The inner ring-shaped element 23 serves to attach to an arm, in particular an upper arm of the user, and preferably to also generate a residual buoyancy. A density for the material of lower density which is preferable for this example embodiment can be 0.1 to 0.3 kg/dm$^3$. A ratio of the density of water to the density of the material of lower density of approximately 3:1 to 5:1, in particular 4:1, is preferable.

The inner ring-shaped element 23 includes two sections 5*a*, 5*b* which can be overlapped. The inner side of the inner section 5*a* is placed on the arm, wherein the outer side pointing away from the arm comprises an element, preferably the velour element, of a Velcro fastening. The outer section 5*b* is placed over the inner section 5*a* and comprises a counter element—preferably the element 6*b* of a Velcro fastening which is coarse and/or provided with hooks—on its side pointing towards the inner section 5*a*. The length with which the velour element 6*a* partially surrounds the circumference of the inner ring 23 is larger than the corresponding length of the other Velcro element 6*b*. The length of the inner ring 23 surrounding the arm 1 can thus be continuously adjusted and adapted to the thickness of an arm.

The inner ring 23 includes at least one layer 10 made of a material having a lower density. The inner ring-shaped element 23 is preferably connected to two of the surrounding ring-shaped elements 24 and 25 at the point of the inner ring 23 which is positioned on the inner side of the arm, i.e. the side with which the arm can be placed on the ribs, when a buoyancy aid is placed on the upper arm. The middle ring-shaped element 24 and the outer ring-shaped element 25 are disconnected at this point. The ends of the two ring-shaped elements 24, 25 point to one another or adjoin one another in each case. Additionally, the ends of the middle element 24 and those of the outer element 25 are placed on top of one another in each case and are sewn to the inner ring 23 using four textile seams, as shown in this example. Two seams 21 of said seams 20, 21 connect the three ring-shaped elements 23, 24, 25. The other two seams 20 connect the three ring-shaped elements 23, 24, 25 and also a covering element 22 which covers the seams 21. The covering element 22 serves to stabilize the point at which the middle ring-shaped element 24 and the outer ring-shaped element 25 are disconnected, and in particular to form a closed ring with the inner ring-shaped element and to relieve the strain on the inner ring-shaped element. In particular, the seams stretch in the longitudinal direction of the arm over at least the width of the narrowest of the ring-shaped elements 23, 24, 25.

The middle and the outer ring-shaped element are also sewn together in the circumferential direction at the edges at which they are placed on top of one another, as shown in FIG. 11. A pocket is thus formed between the middle ring-shaped element 24 and the outer ring-shaped element 25, in which chambers 2*a*, 2*b* which are impermeable to gas can be inserted. The chambers 2*a*, 2*b* are each fluidly independent. Each of the chambers 2*a*, 2*b* is inflated with gas or deflated via a valve 7 of its own. In order to fluidly separate the chambers 2*a*, 2*b* from one another, the walls which form the chambers 2*a* and 2*b* are fused with a seam 29 along the width of the chambers, at the point at which the chambers 2*a*, 2*b* meet. Holes for the valves 7 are provided on the outer ring 25, so that the user of the device can inflate or deflate the chambers.

The buoyancy aid exhibits a smaller width, measured in the direction of the arm, at the point of the fused seam 29 and at the point at which the ring-shaped elements 23, 24, 25 are joined together, than at other points, wherein the width of the buoyancy aid at the point of the fused seam 29 is larger than at the point at which the ring-shaped elements are joined together.

The ring-shaped elements 23, 24 and 25 can in particular exhibit the same density or can even consist of the same material generating the buoyancy. They can have the same thickness, and in the case of a layered design, this can also be the same in each case. The thickness of the ring-shaped elements 23, 24 and 25 is approximately 2 mm. For each of the outer ring-shaped element 25 and the middle ring-shaped element 24, this results in a volume of approximately 110 cm$^3$ for the material of lower density, and for the inner ring-shaped element 23, a volume of approximately 60 cm$^3$ per arm. Merely in order to give an idea of scale, a swimming aid which is approximately fully inflated can be said to have a buoyancy of approximately 26 to 27 N and a swimming aid which is approximately fully non-inflated can be said to have a buoyancy of approximately 5 to 6 N. A preferable buoyancy ratio from being inflated to being non-inflated is 4:1 to 5:1, in particular 4.5:1.

Figure 13:
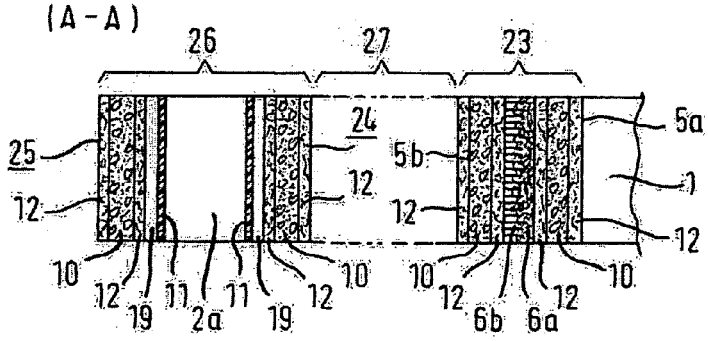
FIG. 13 a schematic view, not to scale, along the section A-A from FIG. 12.

FIG. 13 shows a schematic view, not to scale, along the section A-A from FIG. 12, in order to show a possible design of the buoyancy aid from the outer side of the outer ring-shaped element 25 to the arm 1. The following describes the layered design, starting from the arm 1 and proceeding in the direction pointing away from the arm. The inner ring-shaped element 23 is placed on the arm 1. A gap 27 is located between the floating ring 26 including the outer and the middle ring-shaped element and the inner ring-shaped element 23 and can be increased or reduced according to the level of inflation of the chambers 2*a*, 2*b*.

The inner ring section 5*a* and the outer ring section 5*a* each consist of the material 10 having a lower density and of layers 12 which are film-clad onto this material and, as is described further above, are intended to protect the layer 10 of lower density, for example against damage or abrasion. The ring sections 5*a* and 5*b* are each sewn together with an element 6*a*, 6*b* of a Velcro fastening, whereby the ring sections 5*a*, 5*b* can be joined together.

The floating ring includes the middle and outer ring-shaped elements 24, 25 surrounding the chamber 2*a*. Layers 12 for the purposes cited are respectively film-clad on the middle ring-shaped element 24 and the outer ring-shaped element 25 which each comprise a layer 10 made of the material of lower density. The chamber 2*a* is enveloped by a layer 11 which is impermeable to gas. A gap 19 is respectively shown by the layer 11 which is impermeable to gas, which is intended to illustrate that in this example embodiment specifically, the walls 11 of the chamber 2*a*, which are impermeable to gas, are not connected in a material lock to the outer ring 25 or the middle ring 24.

It should be understood that a buoyancy aid in accordance with the present invention has been described in detail, but may be subject to modifications from other embodiments incorporating inventive features. Accordingly, the foregoing disclosure is intended to be regarded as illustrating the principles of the present invention, as an example of features and not as a delimiting description, which is the purpose of the following claims.

What is claimed:

1. A buoyancy aid for assisting in swimming lessons and for placing onto an arm, comprising:

a) a first element which is ring-shaped or which can be connected into a ring, and which can be arranged on an arm; and b) an inflatable chamber having an inner surface and an outer surface wherein each of the inner and outer surfaces are individually enveloped by a second element which is made from a material having a density lower than the density of water and the inflatable chamber is attached to the first element which is ring-shaped or which can be connected into a ring.

2. The buoyancy aid according to claim 1, wherein the material having a density lower than the density of water exhibits a porosity.

3. The buoyancy aid according to claim 2, wherein the material having a density lower than the density of water exhibits an open porosity.

4. The buoyancy aid according to claim 2, wherein the material having a density lower than the density of water exhibits a closed porosity.

5. The buoyancy aid according to claim 1, wherein the material is a foamed plastic.

6. The buoyancy aid according to claim 1, wherein the chamber is surrounded by a layer made of a material which is impermeable to gas.

7. The buoyancy aid according to claim 1, wherein the ring comprises at least one elastic section, such that the ring can be placed securely onto the arm.

8. The buoyancy aid according to claim 1, wherein a fastening is provided, with which the length of the ring-shaped element which surrounds the arm can be set.

9. The buoyancy aid according to claim 8, wherein the fastening comprises at least two overlapping sections which can be connected together by means of a hook-and-loop fastener, buttons, a zip, a plug connection, a catch connection or clamp connection.

10. The buoyancy aid according to claim 9, wherein the two overlapping sections consist of one strip, the short end of which is folded over its long end.

11. The buoyancy aid according to claim 1 further comprising a valve for inflating and deflating the chamber with a gas.

12. The buoyancy aid according to claim 11, wherein said valve is a safety valve.

13. The buoyancy aid according to claim 1, wherein the ring-shaped element for attaching to an arm is at least partially surrounded by and connected to at least two additional elements which substantially form a ring or can be connected into a ring, wherein the at least one chamber is formed between the at least two additional elements.

14. The buoyancy aid according to claim 13, wherein the at least one chamber is enveloped or substantially completely surrounded by the at least two additional ring-shaped elements.

15. The buoyancy aid according to claim 1, wherein the ring-shaped element for attaching to an arm is connected to the at least one or the at least two additional ring-shaped elements, by at least one seam.

16. The buoyancy aid according to claim 15, wherein the ring-shaped element for attaching to an arm is sewn or fused to the at least one or the at least two additional ring-shaped elements, by at least one seam.

17. The buoyancy aid according to claim 1, wherein the ring-shaped element comprises two strip sections which are placed on top of one another and fused, stuck together, sewn or joined by another joining means known from the prior art, on at least a longitudinal edge.

18. The buoyancy aid according to claim 1, wherein the layer made of the material having a density lower than the density of water is covered, stuck together or film-clad, at least on one side, to the layer made of a material which is impermeable to gas.

19. The buoyancy aid according to claim 1, wherein the layer made of the material having a density lower than the density of water is covered, stuck together or film-clad, at least on one side, to a layer made of a sealing, abrasion-proof, color-tagged and/or textile material.

20. The buoyancy aid according to claim 1, wherein in water, the whole material exhibiting a density lower than that of water, applied to the buoyancy aid, generates half a buoyancy which is large enough for at least one respiratory opening of the user of the buoyancy aid to be located above the surface of the water.

21. The buoyancy aid according to claim 1, wherein the material having a density lower than that of water is layered, wherein the layer exhibits a thickness of 0.1 to 10 mm.

22. The buoyancy aid according to claim 21, wherein the layer exhibits a thickness of 2 to 5 mm.

23. The buoyancy aid according to claim 5, wherein the foamed plastic comprises neoprene.

24. The buoyancy aid according to claim 13, wherein the ring-shaped element for attaching to an arm is connected to the at least one or the at least two additional ring-shaped elements, by at least one seam.

25. The buoyancy aid according to claim 1, wherein the ring-shaped element for attaching to an arm is surrounded at least partially by at least one additional ring-shaped element which is attached to the ring-shaped element for attaching to the arm, and the at least one chamber is formed on the at least one additional ring-shaped element which comprises a hose section in which the at least one chamber is formed or can be inserted.

26. A buoyancy aid for assisting in swimming lessons and for placing onto an arm, comprising:

an inflatable chamber having at least one surface which includes a material having a density lower than the density of water;

an attachment element connected to the inflatable chamber and configured to define a ring having an interior attachment diameter that is independent of a level of inflation in the inflatable chamber; and a fastening is provided with which the length of the ring can be set.

27. The buoyancy aid according to claim 26, wherein the ring comprises at least one elastic section.

* * * * *